United States Patent [19]

Chu et al.

[11] 4,370,659

[45] Jan. 25, 1983

[54] ANTENNA

[75] Inventors: James C. Chu; Patrick E. Crane, both of Tampa, Fla.; Jack V. D'Agostino, Florissant, Mo.; Paul M. Schwartz, Belleair Beach, Fla.

[73] Assignee: Sperry Corporation, New York, N.Y.

[21] Appl. No.: 285,218

[22] Filed: Jul. 20, 1981

[51] Int. Cl.[3] ..... H01Q 1/20

[52] U.S. Cl. ..... 343/772; 343/786

[58] Field of Search ..... 343/772, 773–780, 343/786–787, 907, 851, 862

[56] References Cited

U.S. PATENT DOCUMENTS 2,945,230 7/1960 Elliott ..... 343/772

3,698,000 10/1972 Landry et al. ..... 343/772

*Primary Examiner*—David K. Moore

*Attorney, Agent, or Firm*—Howard P. Terry

[57] ABSTRACT

A broad band millimeter wave finline antenna includes a finline transmission means having a flared end portion formed by tapering the adjacent edges of the finline elements and affixing planar sectoral conducting members to the tapered edges. The finline transmission means may be mounted in a housing that provides a transition for coupling the antenna to exterior waveguides or other transmission means.

9 Claims, 3 Drawing Figures

ANTENNA

BACKGROUND OF THE INVENTION

1. Field of the Invention

The present invention relates to high frequency antennas and more specifically to antennas for use in finline transmission systems.

2. Description of the Prior Art

Finline apparatus for transmitting high frequency electromagnetic energy is well known in the art. Such apparatus contains two thin coplanar conductive fin elements which are spaced apart along their entire length so that the adjacent edges of the fin elements form a narrow slot capable of supporting the electromagnetic field associated with the energy being transmitted and of confining this energy to a narrow region around the finline element. Various antennas for use with finline transmission components have been developed. In one type of prior art antenna, for example, the slot width of a radiating section of the fin elements is tapered linearly outward for a length approximating the free space wavelength of the microwave energy to be radiated. Another prior art antenna, suitable for suitable transmission systems, is the "Vivaldi" antenna wherein flat coplanar plates are tapered outwardly to form a radiating aperture. The Vivaldi antenna is characterized in the tapered edges follow an exponential rather than a linear curve and provide constant beamwidth over a wide frequency range.

The antenna of the present invention provides relatively uniform performance and low side lobes over a wide frequency range, yet is comparatively easy to fabricate and relatively insensitive to dimensional variations.

SUMMARY OF THE INVENTION

The antenna of the present invention employs a pair of sector shaped planar conducting members electrically connected to tapered fin element portions of a finline transmission means so as to provide a transmission means for a wave emerging from the finline transmission means which expands gradually in the planes of both the electric and magnetic vectors associated with that wave.

DESCRIPTION OF THE PREFERRED EMBODIMENT

Figure 1:
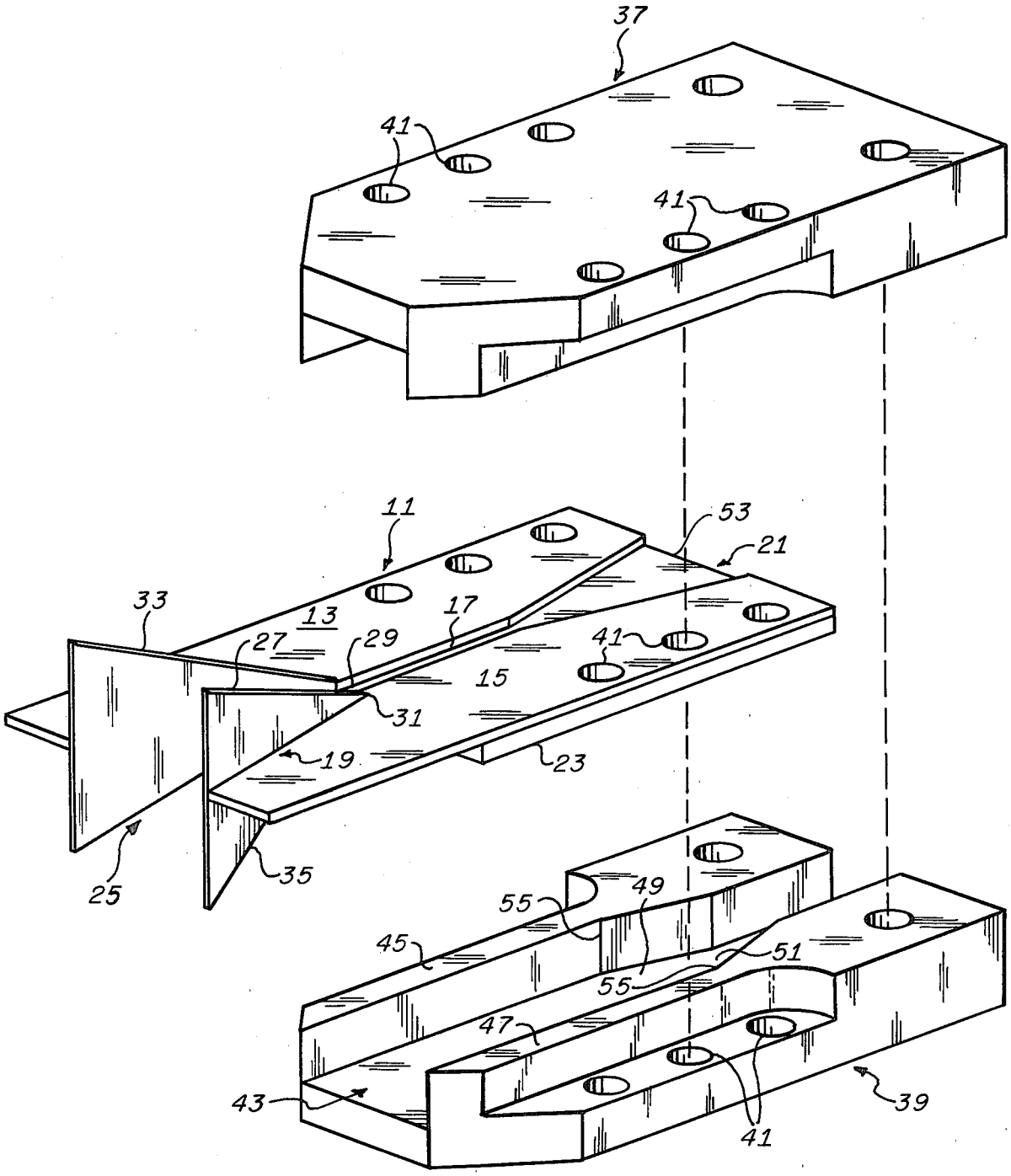
FIG. 1 illustrates an antenna constructed in accordance with the invention.

As depicted in the drawing, a typical antenna constructed in accordance with the principles of the invention includes a finline transmission member 11 which includes first and second thin conductive fin elements 13 and 15 spaced apart along a central portion 17 of their length and serving to transfer electromagnetic wave energy between the antenna portion 19 and a coupling portion 21.

As is typical in finline apparatus, the slot 17 formed between the adjacent edges of the finline elements 13 and 15 is preferably very narrow so that it may permit electromagnetic energy to be transferred efficiently between the end portions 19 and 21.

As shown in the Figure, the fin elements 13 and 15 are maintained in a fixed coplanar relationship by means of a thin sheet dielectric mounting material 23. It is to be understood, however, that various types of finline apparatus are available and may, for instance, consist of a thin sheet of dielectric mounting material having coincident thin conducting elements formed on each side of the dielectric material.

The coupling portion 21 of the invention is formed by tapering the adjacent edges of the finline material so as to provide a gradual transition for coupling energy between the finline element and exterior transmission means such as a waveguide, as will be explained.

The antenna portion 19 is formed by tapering the adjacent edges of the finline material so as to produce an outwardly flared section and inserting planar sectoral conducting elements 25 and 27, which may be triangular shaped, in the flared region. The vertices 29 and 31 of the sectoral members form the throat of the antenna and are positioned to be in electrical contact with the fin elements and provide a smooth mechanical and electrical transition between the uniform slot in the transmission section 17 and the adjacent faces of the sectoral members. The sectoral members are mounted on the fin elements by any suitable means and may, for instance be soldered to the fin elements. The sectoral elements are positioned in planes perpendicular to the plane of the fin elements so as to provide a proper termination of the E field associated with the electromagnetic energy traversing the antenna. The bases 33 and 35 of the sectoral members lie in the plane of the physical aperture of the antenna.

The flare angle of the sectoral elements is not critical and typically lies between 22.5° and 45°. Similarly, the flare angle of the tapered fin elements in the antenna region is not critical and typically lies within the same angular limits as the sectoral members. Typically, the axial length of the sectoral members is in the order of a wavelength in free space of the electromagnetic wave being transmitted.

Typical housing members for coupling the finline element 11 to external transmission means such as a rectangular waveguide are illustrated in the drawing. Upper and lower housing members 37 and 39 contain a series of three mounting holes 41 near one edge of the housing members. These mounting holes are positioned to correspond to similar mounting holes in the finline member 11. A similar set of mounting holes are also provided on the opposite sides of the two housing members and the finline member 11. The various mounting holes are located in the respective elements so that when the respective elements are fastened together with mounting screws, the finline member 11 is precisely positioned with respect to the two housing members as will be explained.

The upper and lower housing elements 37 and 39 are machined to mate with each other and consist of a first channel area 43 which straddles the intermediate transmission section 17 of the finline member 11 and the tapered transition section 21. The walls 45 and 47 of the channel region 43 are preferably N/2 plus one-quarter wavelengths thick (where N is an integer) so as to minimize spurious radiation from the portions 17 and 21 of the finline member 11.

The parallel walls of the channel 43 terminate at a tapered section 49 which forms a transition to a waveguide section 51 that mates with the external waveguide transmission lines to be used with the particular antenna.

The mounting holes 41 are located in the finline member 11 and the two housing members so that the coupling portion 21 is positioned with the plane of its aperture 53 coincident with the entrance to the tapered section 49 at the boundary line 55. The width of the aperture 53 is adjusted to equal the width of the entrance to the tapered section 49 so as to provide a smooth transition between the coupling portion 21 of the finline member 11 and the tapered section 49.

In accordance with known practice, the transmission mode of the electromagnetic energy in the intermediate section 17 of the finline member 11 is such that an E field is established between the adjacent edges of the fin elements and parallel to the plane of these elements. As the wave proceeds through the transition section 21, the E field retains this orientation and persists in the waveguide section 51. Similarly, energy propagating in the antenna portion 19 retains the same orientation of the E field.

Figure 2:
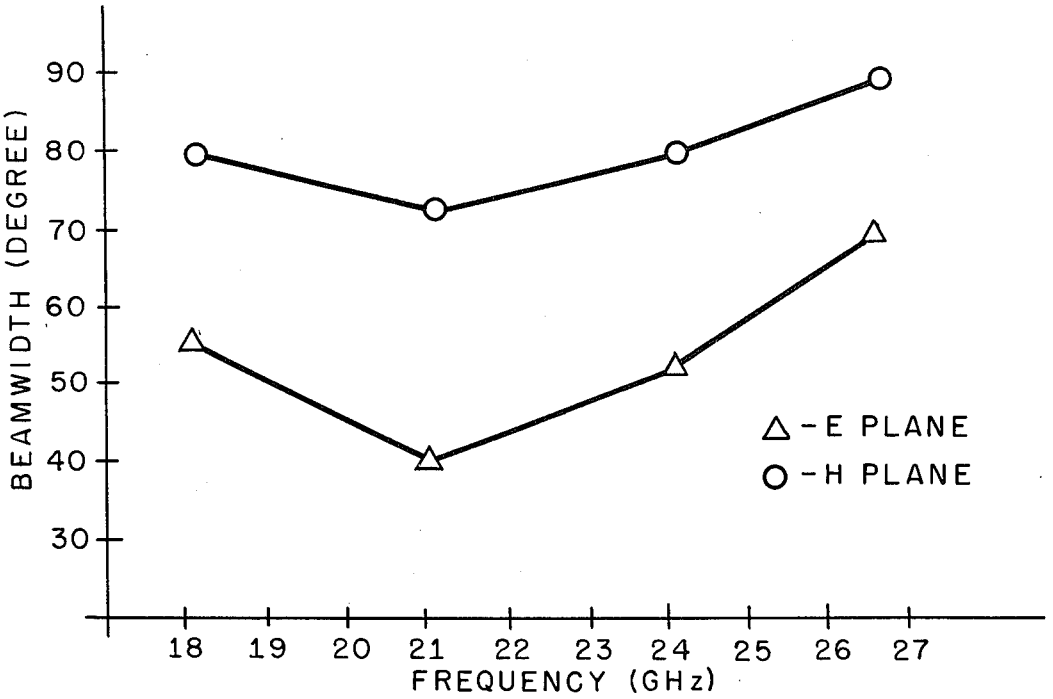
FIGS. 2 and 3 are graphs depicting operating characteristics of an antenna constructed in accordance with the invention.
Figure 3:
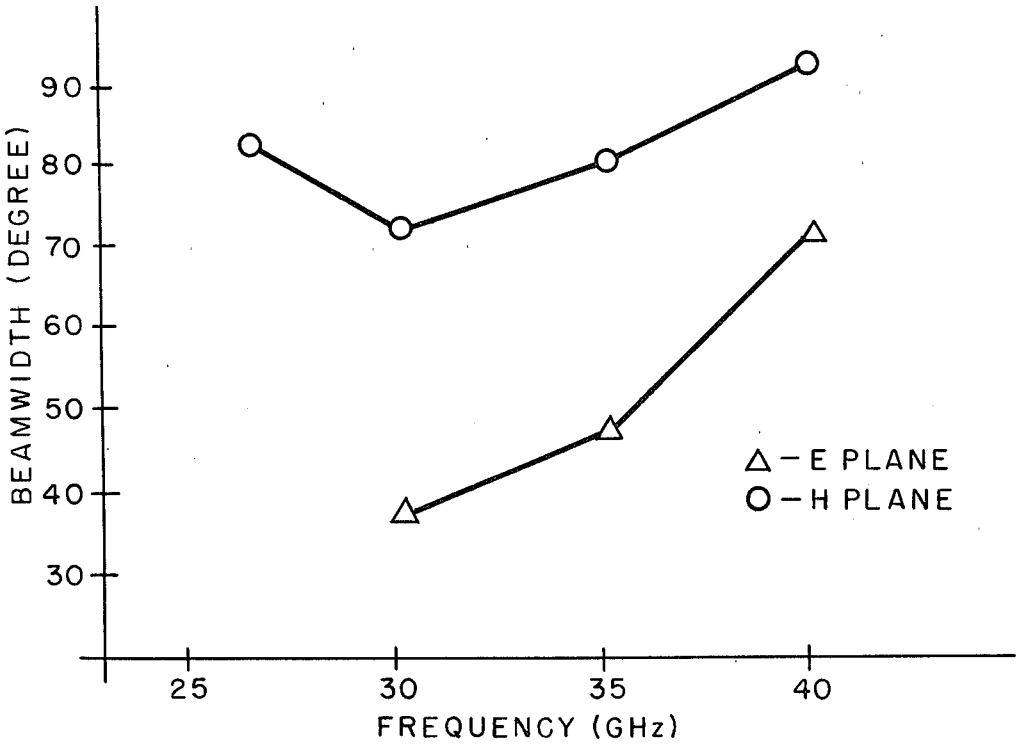

Experiments conducted with antennas constructed in accordance with the principles of the present invention have shown that the physical dimensions of the antenna element are not critical. Typically, an antenna having a flare angle of 45° and sectoral plates having the same flare angle produce a 60° beam width and a 9 decibel antenna gain with side lobes of −20 decibels. Antennas operating in the K band have shown satisfactory performance in the 18–26.5 GHz range and antennas operating in the $K_a$ band have proven to be effective in the 26.5–40 GHz frequency range. Relatively constant beam width in both the E plane and the H plane has been demonstrated as shown graphically in FIGS. 2 and 3. Not only does the antenna of the present invention provide a wide single mode bandwidth, but the antenna operates with low insertion loss and is compatible with hybrid IC and waveguide devices. The equivalent dielectric constant of the antenna is close to unity which avoids the need for excessive miniaturization and thus results in comparative ease of fabrication.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A sectoral antenna for use with finline electromagnetic wave transmission means of the type having two thin coplanar fin elements disposed with adjacent edges forming a narrow channel transmission path having a flare from a first end at a predetermined angle, said antenna comprising first and second triangular shaped planar members, each having a vertex and a base opposite said vertex, said triangular shaped planar members disposed in planes normal to said plane of said fin elements, and supported respectively by said adjacent edges of said fin elements along said flare such that said vertex of each triangular shaped planar member is positioned adjacent said first end of said narrow channel and housing means enclosing said transmission path.

2. The antenna of claim 1, wherein said predetermined angle is substantially 45°.

3. The antenna of claim 2 wherein said normal planes pass respectively through said adjacent edges of said fin members along said flare.

4. The antenna of claim 1 wherein said narrow channel transmission path has a flare from a second end for impedance matching said fin members to waveguide transmission means.

5. The antenna of claim 1, 2, 3, or 4 wherein said triangular shaped planar members are conductively coupled respectively to said adjacent edges of said fin elements along said flare at said first end.

6. A finline antenna comprising two thin coplanar fin elements disposed with adjacent edges forming a narrow channel transmission path having a flare from a first end at a predetermined angle; said antenna further comprising first and second triangular shaped planar members, each having a vertex and a base opposite said vertex, said triangular shaped planar members disposed in planes normal to said plane of said fin elements, and supported respectively by said adjacent edges of said fin elements along said flare such that said vertex of each triangular shaped planar member is positioned adjacent said first end of said narrow channel and housing means enclosing said transmission path.

7. The antenna of claim 6 wherein said narrow channel path has a flare from a second end for impedance matching said fin members to waveguide transmission means, and wherein said narrow channel transmission path comprises an intermediate portion of constant width located between said first end and said second end.

8. The antenna of claim 7 further said housing means including first and second housing members adapted to be mounted on opposite planar sides of said fin elements, each of said housing members including a rectangular channel portion adapted to straddle said intermediate and second end portions of said transmission path, a waveguide portion for connecting said antenna to an external waveguide and a flared portion intercoupling said rectangular channel and said waveguide portions, said housing members including means for positioning said finline members so that the wide end of said flare from said second end of said transmission path is aligned with the plane of the boundary between said channel portion and said flared portion of said housing means.

9. The antenna of claim 6, 7, or 8 wherein said triangular shaped planar members are conductively coupled respectively to said adjacent edges of said fin elements along said flare at said first end.

* * * * *